US007673591B2

(12) United States Patent
Vuk

(10) Patent No.: US 7,673,591 B2
(45) Date of Patent: Mar. 9, 2010

(54) NUCLEATE BOILING COOLING SYSTEM AND METHOD

(75) Inventor: Carl T. Vuk, Denver, IA (US)

(73) Assignee: Deere & Company, Moline, IL (US)

( * ) Notice: Subject to any disclaimer, the term of this patent is extended or adjusted under 35 U.S.C. 154(b) by 0 days.

(21) Appl. No.: 12/136,197

(22) Filed: Jun. 10, 2008

(65) Prior Publication Data

US 2009/0301410 A1 Dec. 10, 2009

(51) Int. Cl.
*F01P 7/00* (2006.01)
*F01P 9/02* (2006.01)

(52) U.S. Cl. ..... 123/41.02; 123/41.2

(58) Field of Classification Search ..... 123/41.01, 123/41.02, 41.1, 41.2, 41.51, 41.54
See application file for complete search history.

(56) References Cited

U.S. PATENT DOCUMENTS

| | | | |
|---|---|---|---|
| 4,662,317 | A | 5/1987 | Ogawa |
| 4,768,484 | A | 9/1988 | Scarselletta |
| 5,723,773 | A | 3/1998 | Bryan |
| 6,247,429 | B1 | 6/2001 | Hara et al. |
| 6,502,655 | B2 | 1/2003 | Peddycord et al. |
| 6,955,141 | B2 | 10/2005 | Santanam et al. |
| 7,069,883 | B2 | 7/2006 | Atkins |
| 7,258,083 | B2 | 8/2007 | Lindsey |
| 7,331,190 | B2 | 2/2008 | Garner et al. |
| 2005/0028756 | A1 * | 2/2005 | Santanam et al. ..... 123/41.1 |

FOREIGN PATENT DOCUMENTS

| | | | |
|---|---|---|---|
| EP | 0182340 | B1 | 4/1991 |
| WO | 0070209 | A1 | 11/2000 |

OTHER PUBLICATIONS

Andrew T. O'Neill; Experimental Determination of Convection Boiling Curves for Water and Ethylene Glycol in a Rectangular Channel with Localized Heating.

European Search Report dated Sep. 8, 2009 for Application 09162210.0-2311.

* cited by examiner

*Primary Examiner*—Noah Kamen
(74) *Attorney, Agent, or Firm*—Taylor & Aust, P.C.

(57) ABSTRACT

A cooling system for a liquid cooled internal combustion engine having coolant passages and a heat exchanger selected to operate the engine cooling system in the region of nucleate boiling. A sensor detect the presence of nucleate boiling and a pump and pressure relief valve responsive to the sensor maintain the coolant system pressure at a level marinating optimum nucleate boiling to increase heat flux from the engine and reduce overall size of the system.

20 Claims, 1 Drawing Sheet

NUCLEATE BOILING COOLING SYSTEM AND METHOD

FIELD OF THE INVENTION

The present invention relates to internal combustion engine systems and more specifically to coolant systems and methods for such systems.

BACKGROUND OF THE INVENTION

One of the principle sources of parasitic losses, complications and bulk in an internal combustion engine has to do with the waste heat generated by the internal combustion engine process. Attempts have been made to manage heat flux from the material surrounding combustion chambers by paying careful attention to flow passages, coolant flow rates and temperatures through such passages. Typically the internal combustion engines are liquid cooled so as to maximize the heat flux to the cooling system, particularly in the region closely adjacent the combustion chamber. When cooling systems operate under off design conditions because of duty cycle or component malfunction, it can lead to a condition of uncontrolled boiling in the coolant passages for the engine. This condition causes complete loss of liquid to metal contact and drastically reduces the heat flux carried away by the cooling system. When this is left uncontrolled, the pressure relief for the system, usually a radiator cap, is opened to release pressure and allow even greater generation of steam. This, in turn, has a potentially catastrophic affect on the temperature of the internal metal parts of the engine.

There is, however, a condition between normal liquid flow conditions and uncontrolled boiling that provides an optimum heat flux from the parts to be cooled by the liquid cooling system. This is known as nucleate boiling in which bubbles are generated on a microscopic scale. This allows significant increases in heat flux, but this condition, at best, is a momentary transition between sub-boiling conditions and uncontrolled or macro-boiling.

What is needed in the art therefore is a cooling system which effectively maintains nucleate boiling in an engine cooling system to maximize heat flux from the engine combustion chamber.

SUMMARY OF THE INVENTION

In one form, the invention is a cooling system for a liquid cooled internal combustion engine. The system includes coolant passages formed at least around a combustion chamber for the engine. A heat exchange device is fluidly connected to the passages for dissipating heat from at least around the combustion chamber. A pump for circulating coolant through the passages and the heat exchanger is selected to promote nucleate boiling at least around the combustion chamber. A sensor is provided for indicating the presence of nucleate boiling in the system and a device responsive to the sensor maintains the pressure in the system at a level permitting controlled nucleate boiling to increase heat flux from at least around the combustion chamber.

In another form, the invention is a power system including a liquid cooled internal combustion engine having at least one combustion chamber, the engine having coolant passages at least around the one combustion chamber. A heat exchange device has internal flow passages and is fluidly connected to the coolant passages. A pump is provided for circulating coolant through the passages and the heat exchange device for removing heat from at least around the combustion chamber.

The coolant passages heat exchange device and the pump are selected to promote nucleate boiling at least around the combustion chamber. A sensor is provided for indicating the presence of nucleate boiling of coolant in the system and a device responsive to the sensor maintains the pressure in the system at a level permitting nucleate boiling to increase the heat flux from at least around the combustion chamber.

In still another form, the invention is a method of operating a liquid cooled internal combustion engine having at least one combustion chamber. The method includes the steps of circulating liquid coolant at least around the combustion chamber such that the coolant is operating in the region of nucleate boiling. The presence of nucleate boiling is sensed around at least the combustion chamber and the pressure of the liquid coolant in response to the sense pressure of nucleate boiling is maintained at a level providing an optimum nucleate boiling level.

DETAILED DESCRIPTION OF THE INVENTION

Figure 1:
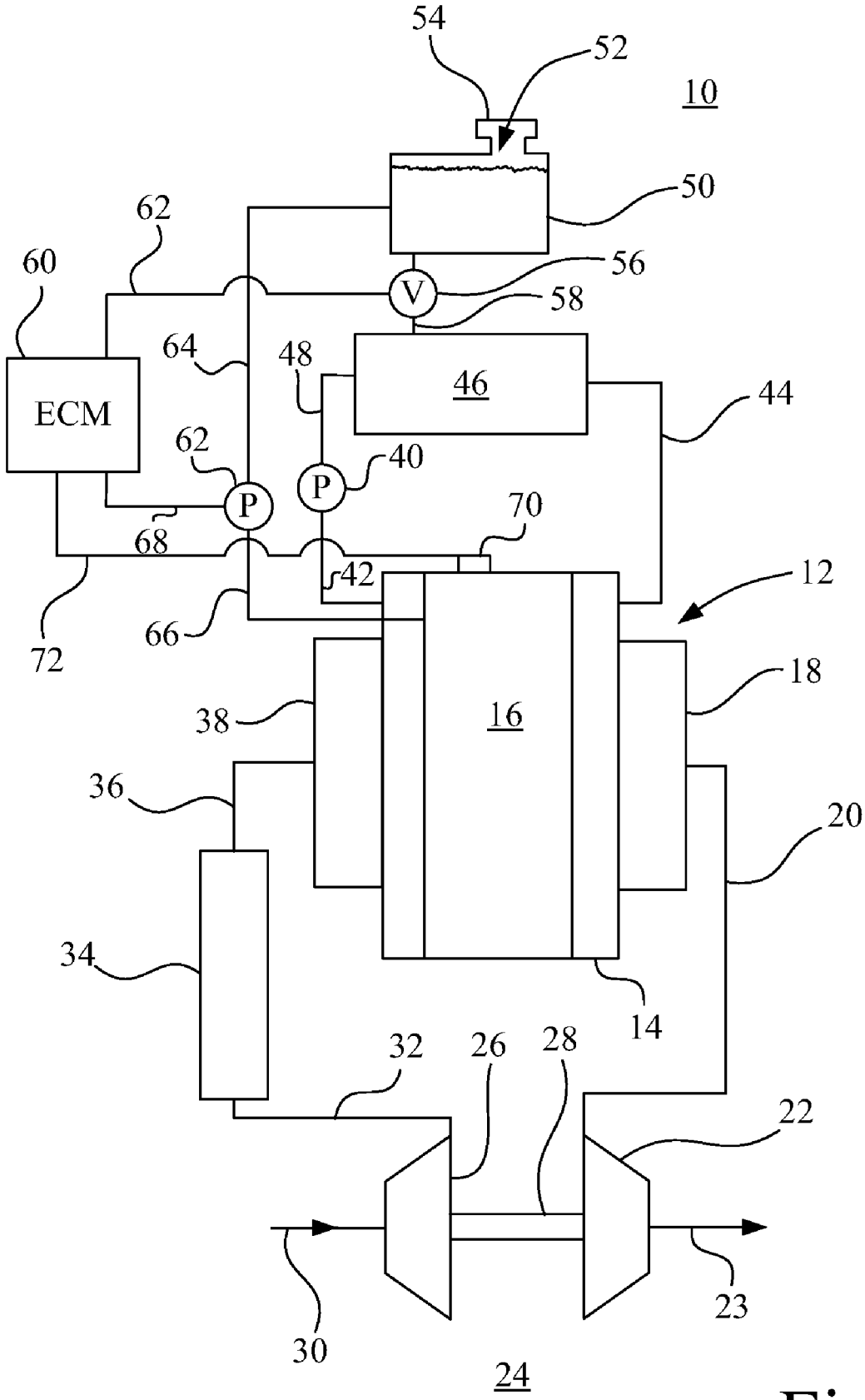
FIG. 1 shows a schematic view of a power system having an internal combustion engine with a coolant system embodying the present invention.

Referring to FIG. 1, there is shown a power system 10 having an internal combustion engine, generally indicated by reference character 12. Internal combustion engine 12 may be one of a number of types of engines in terms of combustion process but is usually a liquid cooled internal combustion engine 12 having a block 14 and a head 16, both of which have internal surfaces exposed to a combustion chamber of variable volume provided by reciprocating pistons all connected to an output crankshaft to provide a rotary power output. Details of the internal portions of block 14 and head 16 are not shown to simplify the understanding of the present invention. Engine 12 has an exhaust manifold 18 receiving products of combustion and delivering them through an exhaust conduit 20 to a turbine 22 of a turbocharger 24 and ultimately to an exhaust conduit 23 leading to ambient. The turbine 22 drives a compressor 26 through a common shaft 28. The compressor 26 receives ambient air from an inlet 30 and delivers it through inlet line 32, usually past an aftercooler 34, and line 36 to an intake manifold 38.

The engine 12 is an air breathing, fuel consuming internal combustion engine in which a hydrocarbon based fuel is burned to provide a rotary power output. Many other features such as exhaust gas recirculation (EGR) and exhaust after-treatment may be employed as appropriate. However, these are not shown to further simplify the discussion of the present invention.

The engine 12, as stated previously, is a liquid cooled engine in which internal coolant passages within the block 14 and head 16 carry away the waste heat generated from the combustion process. The coolant is pressurized by a pump 40 through passage 42 to the engine 12 where it is circulated through appropriately sized and positioned passages to carry heat away from engine 12. Pump 40 is usually mechanically driven by engine 12. The coolant, with the additional heat input passes through line 44 to a heat exchanger 46 to dissipate the increase in heat. Heat exchange device 46, in usual fashion, may be a radiator of the liquid to air type in which the coolant passing through line 44 traverses multiple internal flow passages (not shown). In heat exchange device 46, ambient air is forced over the exterior of the passages, usually with extra heat exchange surfaces to carry away the heat to the ambient air. A return line 48 is connected from the outlet of heat exchange device 46 and feeds the inlet to pump 40. The heat exchange device 46 may have a top tank (not shown) but, in addition, it has a reservoir 50 exposed to ambient pressure at 52 and having a cap 54 for replenishment of fluid. A valve 56 is interposed in a line 58 extending from heat exchange device 46 to reservoir 50. Valve 56, as herein shown, is electrically actuatable by an ECM 60 via a signal line 62. ECM 60 also controls a pump 62 receiving coolant from reservoir 50 via line 64 and connected via line 66 to the engine 12, illustrated herein as connecting to the head 16. Pump 62 is preferably electrically powered and controlled by a signal from line 68 extending from ECM 60. A sensor 70 is connected to ECM 60 via a line 72. Sensor 70 preferably is connected to the head 16 of engine 12 so as to determine conditions closest to the engine combustion chambers. Sensor 70 is a sensor enabling the detection of nucleate boiling. This may be accomplished by making sensor 70 a pressure sensor that senses differential pressure versus differential time or another words the rate of change of pressure versus time. This would determine that the conditions are approaching nucleate boiling and can determine effectively whether the conditions have gone beyond nucleate boiling to macro-boiling or an out of control situation. Another, alternative measurement would be to provide sensor 70 in the form of a temperature sensor sensing the differential temperature versus differential time. Again this is an indicator of going beyond nucleate boiling and into the macro-boiling conditions. Still other sensor forms for 70 may take the form of bubble detectors such as an optical device calibrated to respond to bubbles of a given size or a sonic sensor also calibrated to determine the size of bubbles.

The component parts of the engine 12 and more specifically the coolant passages within engine 12 and heat exchanger 46 are selected with due regard to the duty cycle of the engine so that the engine 12, in combination with its cooling system operates, in the region of and promotes nucleate boiling. In order for the engine condition to be controlled within a relatively tight range of nucleate boiling, the sensor 70 determines the presence of nucleate boiling and sends a signal to ECM 60 which in turn actuates pump 62 to pressurize the cooling system within engine 12 to maintain nucleate boiling conditions. The pump 62 does not have to be a high volume pump since it is pressurizing a liquid within rigid confines so that brief actuation is sufficient to raise the pressures to appropriate levels. A typical pressure for maintaining nucleate boiling is between three and four bars. In order to control the upper level of pressure, valve 66 responds to signals from the ECM 60 via line 62 to release pressure to reservoir 50 maintained at essentially ambient pressure. The valve 66 preferably is electrically controlled and a fast responding valve so that a tight control may be maintained over the conditions that produce nucleate boiling.

The ultimate effect of such a cooling system is to enable higher system operating temperatures up to 150 C and a more compact engine envelope because of a higher potential heat flux of waste heat from the combustion process.

Having described the preferred embodiment, it will become apparent that various modifications can be made without departing from the scope of the invention as defined in the accompanying claims.

The invention claimed is:

1. A cooling system for a liquid cooled internal combustion engine, said system comprising:

coolant passages formed at least around combustion chamber for said engine;

a heat exchange device fluidly connected to said passages for dissipating heat from at least around the combustion chamber;

a pump for circulating coolant through said passages and said heat exchanger, said coolant passages, heat exchange device and pump being selected to cause nucleate boiling at least around said combustion chamber;

a sensor for indicating the presence of nucleate boiling in said system, a device responsive to said sensor for maintaining the pressure in said system at a level permitting nucleate boiling to increase the heat flux from at least around the combustion chamber, said sensor being selected from one of a pressure responsive sensor generating a signal proportional to the change in pressure over change of time and a bubble detector.

2. The cooling system as claimed in claim 1, wherein said sensor includes a temperature sensor indicating a signal responsive to the change in temperature over the change in time.

3. The cooling system as claimed in claim 1, wherein said sensor is a bubble detector selected from one of an optical sensor and an ultrasonic detector.

4. The cooling system as claimed in claim 1, wherein said engine has a head portion, at least a portion of which is in contact with the engine combustion chamber and said sensor is connected to said head for sensing nucleate boiling.

5. The cooling system as claimed in claim 1, wherein said device for maintaining the pressure in said system is a pump.

6. The cooling system as claimed in claim 5, wherein said engine has a head, at least a portion of which is exposed to the combustion chamber for said engine and said pump is connected to said head.

7. The cooling system as claimed in claim 5, wherein said pump is electric powered.

8. The cooling system as claimed in claim 5, including a pressure relief valve for responsive to said nucleate boiling sensor for reducing pressure to maintain nucleate boiling.

9. The cooling system as claimed in claim 8, including a cooling system reservoir wherein said reservoir contains coolant and said pump draws coolant from said reservoir to pressurize said system and said relief valve discharges pressurized coolant to said reservoir.

10. A power system comprising:

a liquid cooled internal combustion engine having at least one combustion chamber, said engine having coolant passages at least around said one combustion chamber;

a heat exchange device having internal flow passages and fluidly connected to said coolant passages;

a pump for circulating coolant through said passages and said heat exchange device for removing heat from at least around said combustion chamber, said coolant passages, heat exchange device and first pump being selected to cause nucleate boiling at least around said combustion chamber;

a sensor for indicating the presence of nucleate boiling of said coolant in said system said sensor being selected from one of a pressure sensor indicating the change in pressure over change in time and a bubble detector; and a device responsive to said sensor for maintaining the pressure in said system at a level permitting nucleate boiling to increase the heat flux from at least around said combustion chamber.

11. The power system as claimed in claim 10, wherein said sensor includes a temperature sensor indicating the change in temperature over the change in time.

12. The power system as claimed in claim 10, wherein said sensor is a bubble detector selected from one of an optical sensor and an ultrasonic sensor.

13. The power system as claimed in claim 10, wherein said engine has a head at least a portion of which is directly connected to said combustion chamber and said sensor is connected to said head.

14. The power system as claimed in claim 10, wherein said pressure maintaining device comprises a pump.

15. The power system as claimed in claim 14, wherein said pump is connected to cooling passages in said head.

16. The power system as claimed in claim 14, wherein said pump is electric powered.

17. The power system as claimed in claim 14, including a pressure relief valve responsive to said nucleate boiling sensor for reducing pressure.

18. The power system as claimed in claim 17, including a reservoir for coolant from which said pump draws coolant to pressurize said cooling system and said relief valve discharges fluid to said reservoir.

19. A power system comprising:

a liquid cooled internal combustion engine having at least one combustion chamber, said engine having coolant passages at least around said one combustion chamber;

a heat exchange device having internal flow passages and fluidly connected to said coolant passages;

a pump for circulating coolant through said passages and said heat exchange device for removing heat from at least around said combustion chamber, said coolant passages, heat exchange device and first pump being selected to cause nucleate boiling at least around said combustion chamber;

a sensor for indicating the presence of nucleate boiling of said coolant in said system;

a pump responsive to said sensor for maintaining the pressure in said system at a level permitting nucleate boiling to increase the heat flux from at least around said combustion chamber; and a pressure relief valve responsive to said nucleate boiling sensor for reducing pressure.

20. The power system as claimed in claim 19, including a reservoir for coolant from which said pump draws coolant to pressure said cooling system and said relief valve discharges fluid to said reservoir.

* * * * *